United States Patent [19]

Garcia

[11] 4,052,823

[45] Oct. 11, 1977

[54] TAP TRANSPORT DEVICE

[75] Inventor: José Fernández Garcia, Barcelona, Spain

[73] Assignee: Ferg S.L., Vich, Spain

[21] Appl. No.: 722,335

[22] Filed: Sept. 9, 1976

[30] Foreign Application Priority Data

Dec. 29, 1975 Spain ..... 443918

[51] Int. Cl.[2] ..... B24B 3/18; B24B 47/02

[52] U.S. Cl. ..... 51/95 TG; 51/215 H; 51/215 UE

[58] Field of Search ..... 51/95 TG, 215 CP, 215 H, 51/91, 105 R; 214/1 BB, 1 BT

[56] References Cited

U.S. PATENT DOCUMENTS

| | | | |
|---|---|---|---|
| 3,954,164 | 5/1976 | Bottomley | 51/215 H |
| 3,994,099 | 11/1976 | Palmer | 51/215 H X |

*Primary Examiner*—James L. Jones, Jr.
*Assistant Examiner*—Nicholas P. Godici
*Attorney, Agent, or Firm*—Michael J. Striker

[57] ABSTRACT

A tap transport device is used in combination with a thread-cutting machine having a chuck adapted to hold a workpiece to be threaded and to rotate this workpiece about a threading axis. The tap transport device comprises a support frame adjacent the machine on which a carrier is displaceable in a first direction transverse to the threading axis. A workpiece feed gripper and a workpiece removal gripper are mounted on the carrier and hydraulic cylinders are provided for opening and closing these grippers and thereby grasping and releasing a workpiece. A magazine is provided on the support frame spaced in the first direction from the threading axis for holding a plurality of unthreaded workpieces and feeding these workpieces to the workpiece feed gripper. A hydraulic ram is provided for displacing the carrier in a second direction transverse to the threading axis and to the first direction between a feed position with the feed gripper aligned in the first direction with the threading axis and a removal position with the removal gripper aligned in the first direction with the threading axis. Yet another cylinder can displace the carrier in the first direction between an outer end position with the grippers aligned in the second direction with the magazine and an inner end position with the grippers aligned in the second direction with the threading axis. Thus when in the inner end position displacement of the carrier into the feed position aligns a workpiece in the feed gripper with the threading axis and displacement of the carrier into the removal position aligns the workpiece in the removal gripper with the threading axis. Another cylinder is provided for displacing the carrier in a third direction generally parallel to the axis.

15 Claims, 16 Drawing Figures

FIG. 13
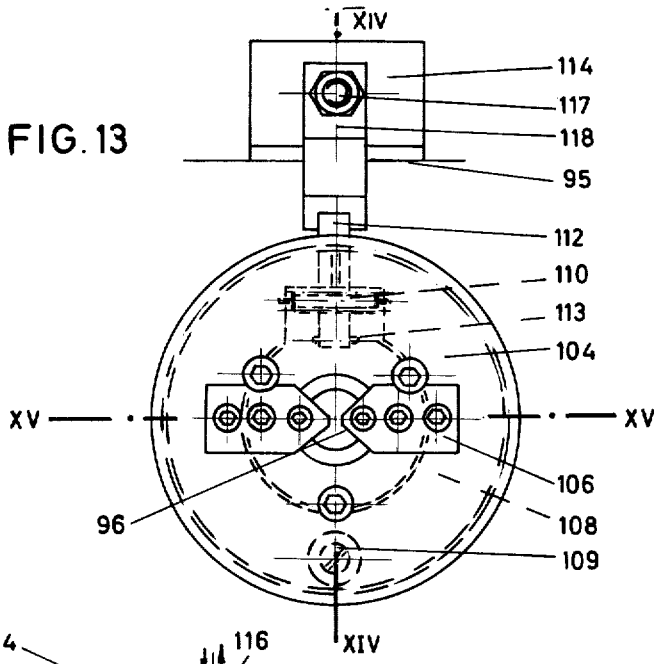
FIG. 14
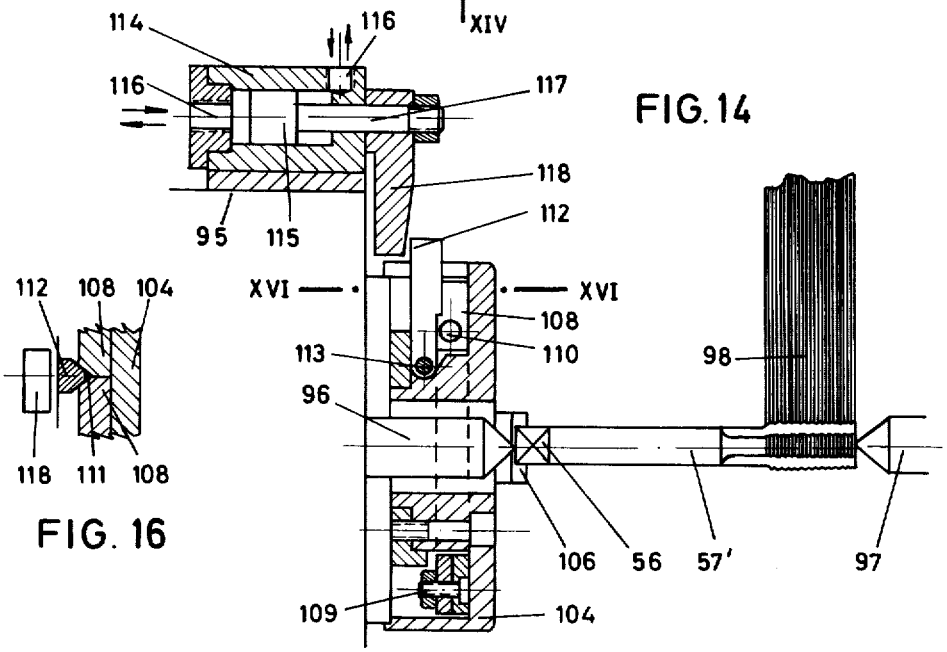
FIG. 16
FIG. 15
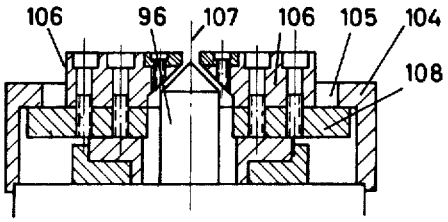

TAP TRANSPORT DEVICE

BACKGROUND OF THE INVENTION

The present invention relates to a device for automatically collecting taps threaded by a tap-threading machine and for feeding unthreaded taps to this threading machine. More particularly this invention concerns such a device with a plurality of mechanical and hydraulic elements combined so as to automatically feed a succession of unthreaded taps to the thread-cutting machine automatically without any manual intervention necessary on the part of the operator other than simply watching the device as well as the thread-cutting machine.

SUMMARY OF THE INVENTION

Thus the device according to the present invention is a hydraulic and mechanical assembly which can be coupled to a conventional threading machine and comprising a support frame having guide bars which can move parallel and transverse to an axis which passes through the machining head of the thread-cutting machine which has an articulated arrangement which permits of varying the inclination of a gripper or collect and transport device so that it can assume either of two vertically spaced positions with relation to a chuck center having jaws located in one of the thread-cutting machine heads. Means is also provided in the device for continuously feeding it with blank taps which are transported to the threading area once threaded taps are also withdrawn by the device and dropped on a conveyor belt which transports them to a collector. All of the hydraulic cylinders which move the various elements of the machine are connected to lines which in turn are connected to a supply of liquid under pressure and a controller operated by push-buttons for manual or automatic operation.

In order to understand the present invention there is attached nine pages of drawings showing an embodiment of the tap-transport device of this invention shown merely as an example and without any limitation of the scope of this invention.

BRIEF DESCRIPTION OF THE DRAWING

FIG. 13 is a front elevation of a thread-cutting chuck modified according to this invention; and FIGS. 14, 15 and 16 are sections taken along lines XIV—XIV, XV—XV and XVI—XVI of FIGS. 13 and 14.

SPECIFIC DESCRIPTION OF A PREFERRED EMBODIMENT

Figure 1:
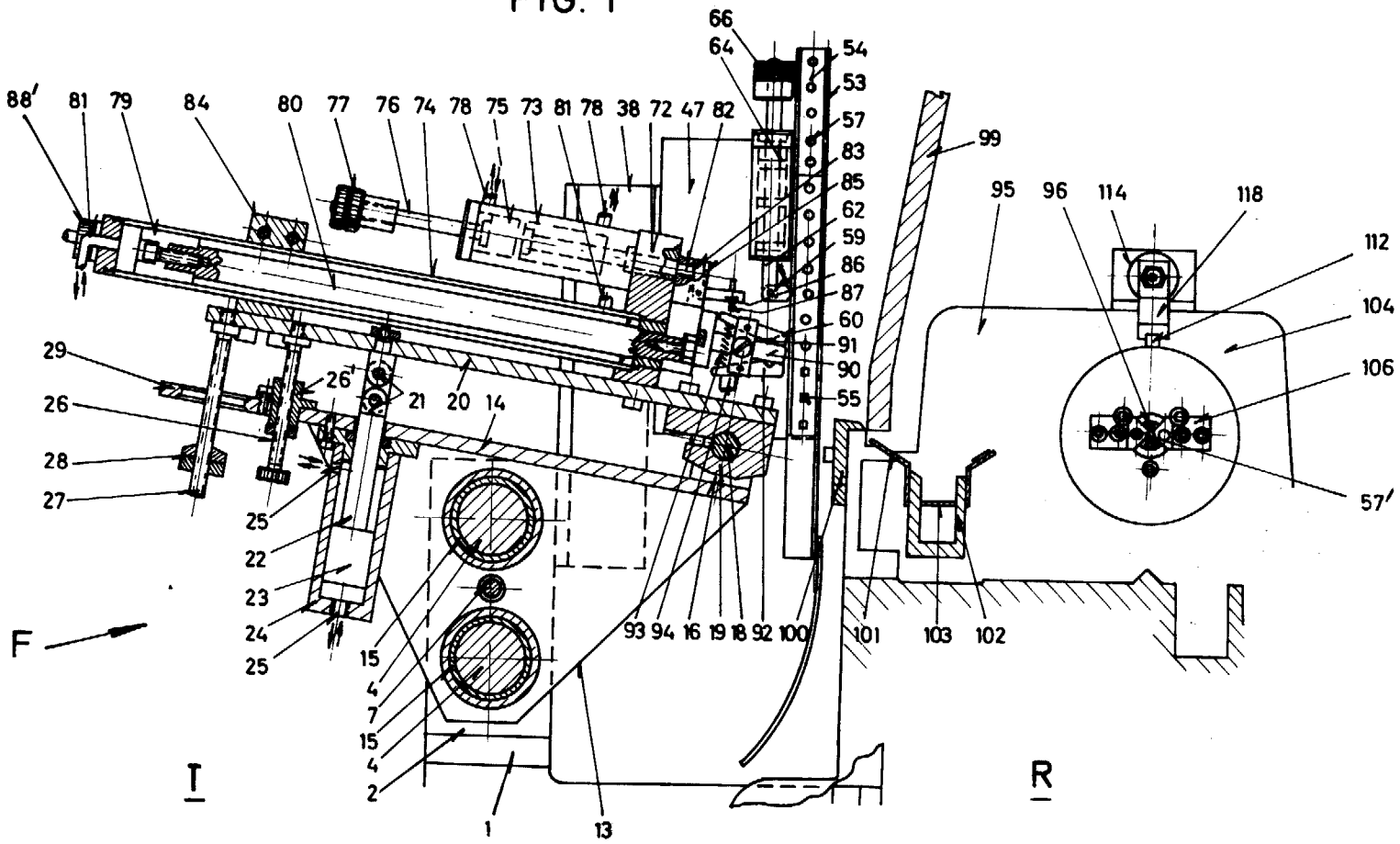
FIG. 1 is a vertical section through the device of this invention fitted to a conventional thread-cutting machine.

In the drawing a tap transport assembly T is shown mounted on a thread-cutting machine R.

The transport arrangement comprises a support or frame 1 joined by two angle pieces 3 to a wall 2. Two cylindrical parallel and superposed guide bars 4 extend from one side of the wall 2 while a cylinder 5 (FIG. 2) extends from the opposite side wall 2, and has a piston 6 through which a threaded shaft 7 passes that carries on its one a knurled knob 8 and on its smooth end a second smaller piston 9 which is reciprocal in a cylinder 10 having hydraulic input and output connections 11 for advance or rectraction of the piston 9. The cylinder 5 is also provided with hydraulic connections 12 serving the same function.

Figure 2:
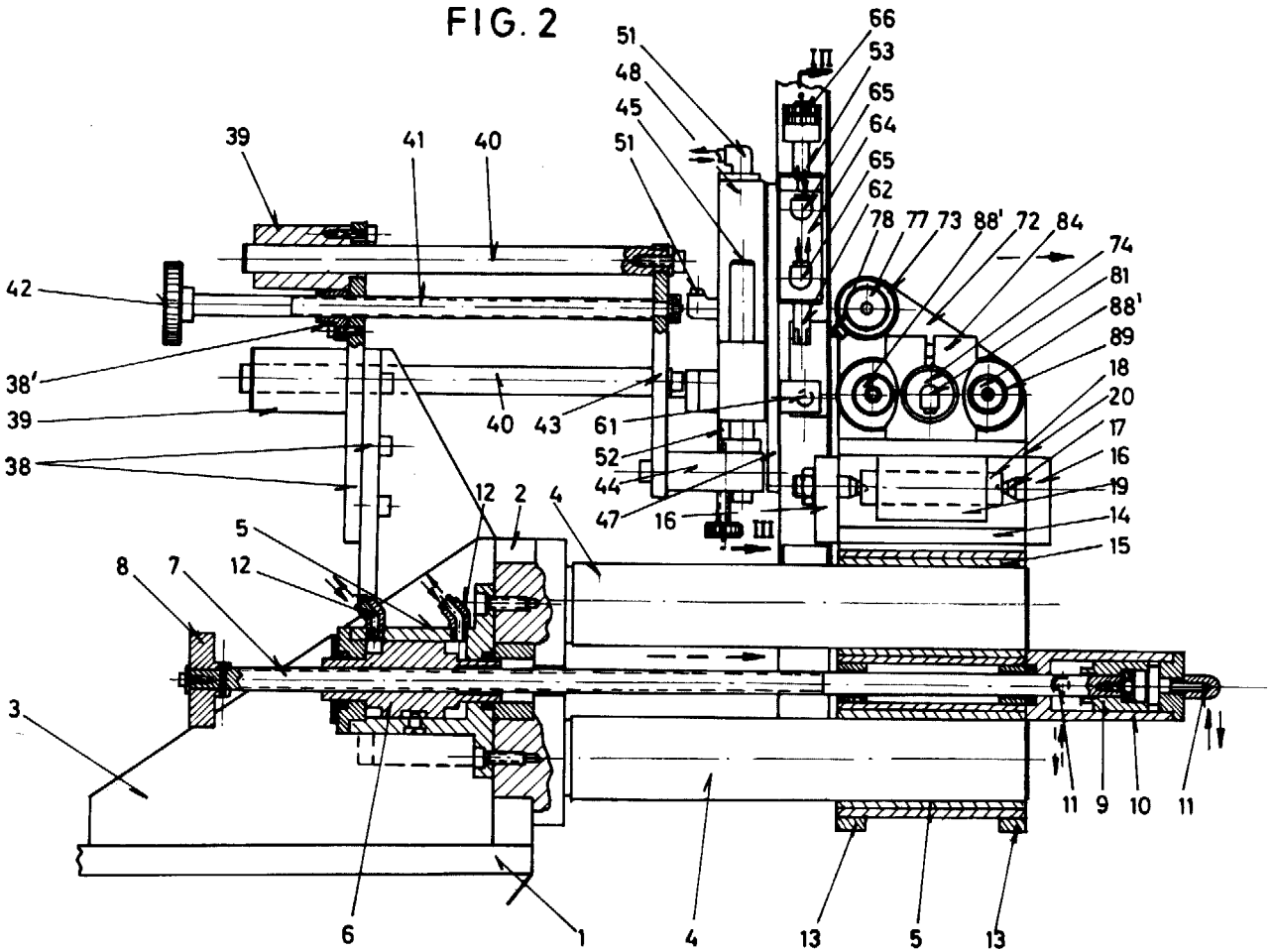
FIG. 2 is a rear partial cross section taken in the direction of arrow F in FIG. 1.

A frame composed of two angle plates 13 joined by a platform 14 has bearings 15 for sliding along the guide bars 4 and is fastened to the shaft angle plates 2 by means of coupling elements shown in FIG. 2. Two front lugs 16 extend upwardly from the platfrom 14 and carry pivot points 17 for a shaft 16 extending integrally through a drum 19 which in turn is integral with a second platform 20 carrying at its rear end an articulation 21 connected to a rod 22 of a piston 23 housed in a cylinder 24 having input and output holes 25 for the hydraulic fluid which operates the piston for forward and reverse movement. Next to this cylinder 24 there is a control screw 26 having a knurled head and threaded through a bushing 26' fixed to the lower platform 14 and another similar screw 27 is fixed to the upper platform 20 and fitted with a double regulating nut 28 which loosely passes through an opening 29 in the platform 14.

Figure 5:
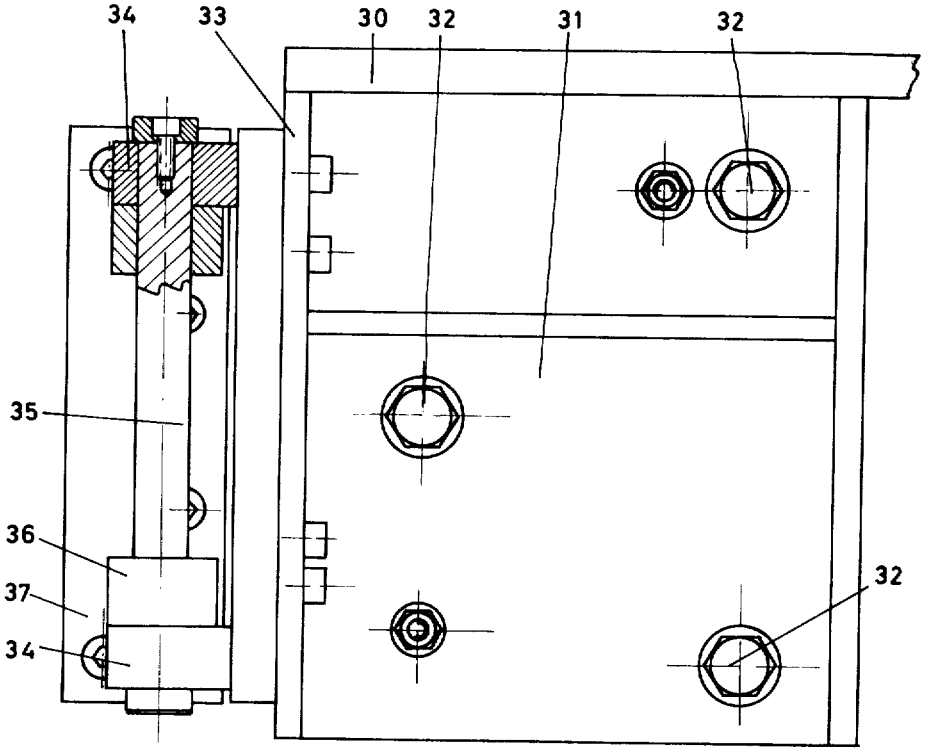
FIG. 5 is a partial elevational view taken in the direction of arrow F' of FIG. 4.
Figure 4:
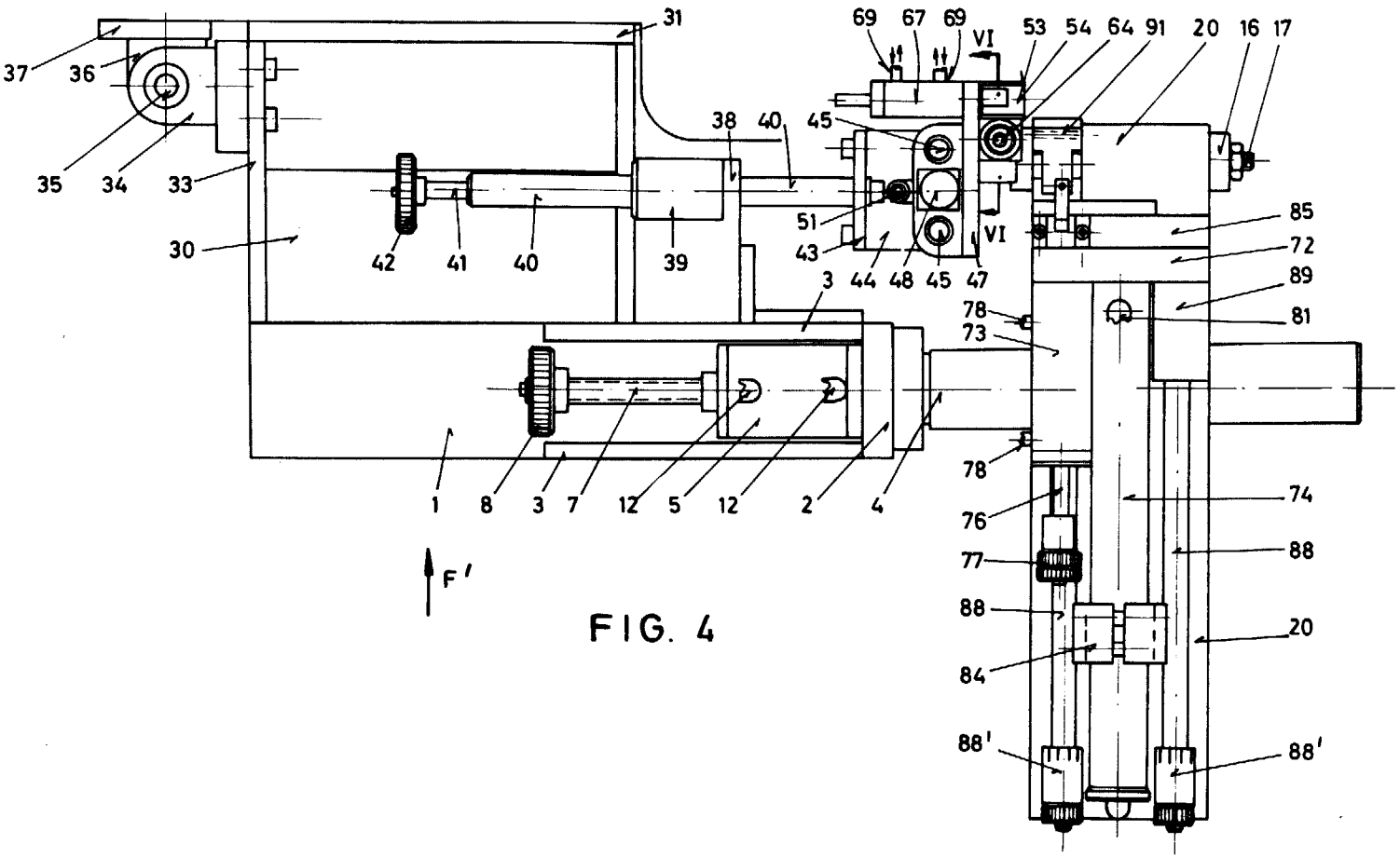
FIG. 4 is a top view of the structure of FIG. 2.

Extending laterally from the support 1 is a plate 30 (FIGS. 4 and 5) having a perpendicular wall 31. This wall 31 is fastened to the front part of the thread-cutting machine R by means of screws 32. Lugs 34 extend from the side 33 of the perpendicular plate 30 and are hinged by means of a shaft 35 and lugs 36 of a mounting plate 37 joined to the thread-cutting machine R. This structure forms a hinge which allows moving of the transport device toward and away from the machine at an angle by operation of the screws 32.

Figure 3:
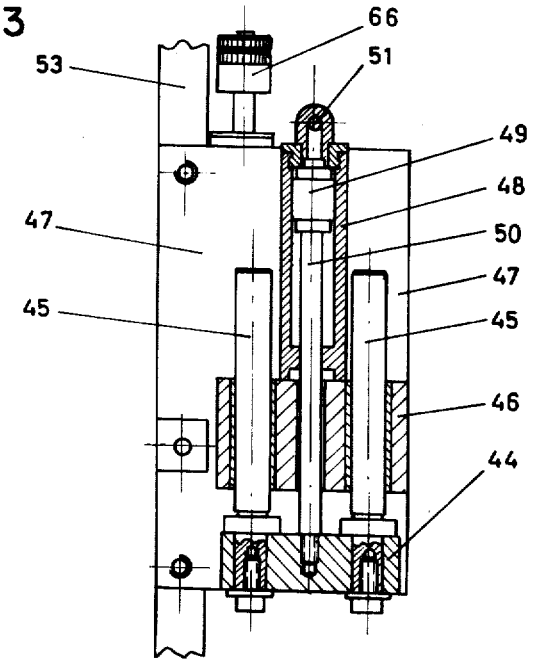
FIG. 3 is a section taken along line III—III of FIG. 2.

Another wall 38 extends upwardly (FIG. 2) from the plate 30 and carries two bearings 39 for two parallel and superposed guide rods 40. This wall 38 has a bushing 38' in which is threaded a rod 41 having on one end a knurled knob and at its other end being joined to plate 43 which is also fastened to guides 40, this plate 43 being joined to a shelf 44 upwardly from which extend two parallel guide rods 45 along which may slide a bearing holder 46 (FIG. 3) joined to a flat body 47 to which is fastened a cylinder 48 having a piston 49 and a shaft holder 50 coupled to the shelf 44. The cylinder 48 has fluid input and output connections 51. In order to regulate the stroke of piston 49 there is provided an adjustment screw 52 threaded through the shelf 44 and engageable against the bearing holder 46 (FIG. 2).

Figure 6:
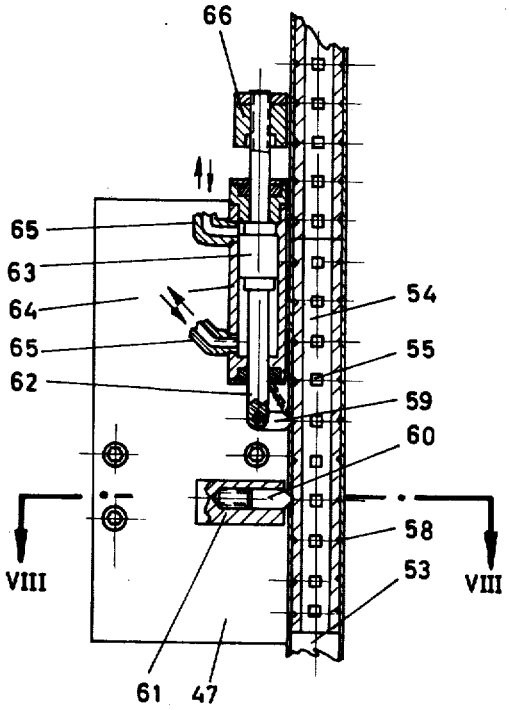
FIG. 6 is a section taken along line VI—VI of FIG. 4.
Figure 7:
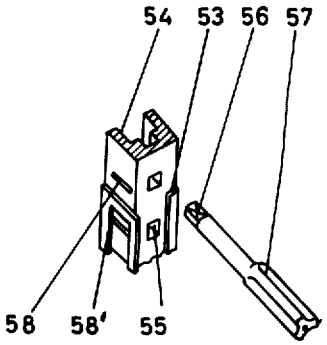
FIG. 7 is a top perspective view of a detail of FIG. 6.

On the other side of the plate 47 there is provided a U-shaped vertical guide 53 holding a magazine or stack of chasers 54 open on one side and formed on the other side with square openings 55 which receive pegs of taps 57 to be threaded (FIG. 7). These chasers 54 which form the transport device loader have side notches 58 to which access can be gained through a small window 58' in the guide 53 and with which two pins cooperate, one formed as a hinged and biased pawl 59 and the other pin 60 sliding in a guide box 61 and also biased. The drive pin 59 is joined to a shaft 62 of a piston 63 slidable in a cylinder 64 having input and output connections 65 for hydraulic drive fluid. The piston rod 63 has a knurled knob 66 on its end for regulating the piston stroke (FIG. 6).

Figure 8:
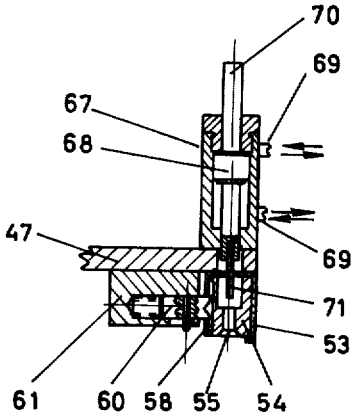
FIG. 8 is a section taken along VIII-13 VIII of FIG. 6.

Extending transverse to the magazine 54 and integral to the plate 47 itself there is provided as shown in FIG. 8 a small cylinder 67 having a piston 68 provided with hydraulic fluid inputs and outputs 69, the shaft 70 of the piston 68 having a shank extension 71 which is always lined up with one of the square holes 55 of the chasers 54. This shank serves to free when actuated the corresponding blank tap 57 to be threaded from its holding point in the magazine 54.

Platform 20 is provided with a block 72 supporting an upper cylinder 73 and a lower cylinder 74, the former provided with a piston 75, a piston shaft 76 with an adjustable knurled knob 77, and fluid input and output lines 78, the latter having a piston 79, a piston shaft 80, and inputs and outputs 81 for the drive fluid.

The shaft 76 of the piston 75 of cylinder 73 has as shown in FIG. 1 on its extreme front end a large-diameter portion 82 and a small-diameter portion 83. The end of the shaft 80 of cylinder 74 which is supported at its other end by a block 34 is joined at its front part to a second mobile body 84 which carries a pivoted L-shaped lever 86 having an adjustment screw 87. This body 85 has an opening in which only the small-diameter portion 83 of the shaft 76 can penetrate, while the large-diameter portion 82 can move through the respective opening in the stationary body 72.

The mobile body 85 is integral with two cylindrical side bars 88 (FIG. 4) which are parallel to each other and movable on bearings 89 forming part of body 72, these guide bars 88 also having knurled adjustment knobs 88'.

Extending upwardly from the front part of the body 85 is a carrier or piece 90 common to two grippers or collets 91 and 92 both pivoted around the element 90 and biased by a spring 93 into the closed position. The upper collet 91 cooperates with a pressure adjustment screw 87 of the elbow lever 86 while the lower collet 92 has a stop 94.

In the threading machine section R there is a head 95 holding as shown in FIGS. 13 - 15 the normal point 96 which cooperates with a point 97 to hold a workpiece, here a tap 57 to be threaded by a grinding wheel 89 in the manner known per se. The lower part of the front wall 99 of the machine according to the invention is provided with a beveled stop 100 which cooperates with stop 94 of the lower collet 92. There is provided next to element 100 a ramp 101 which ends in a channel 102 extending transverse to the main shaft of the transport device 7 and equipped with an endless belt 103 so as to communicate with a final collector (not shown) where all of the finished threaded taps are collected.

A hollow chuck (FIGS. 13 - 16) is carried on the head 95 and has front openings 105 in which two jaws 106 form a mouth 107 to retain an unthreaded tap 57 by means of its peg 56. These jaws 106 are joined to two arcuate levers 108 pivoted at 109 and biased toward each other by means of a spring 101 and their other ends. In this area the levers 108 each have a bevel 111 which cooperates with a wedge 112 pivoted at 113 on a fixed point within the chuck 104.

The head 95 carries another cylinder 114 (FIG. 14) having a piston 115, fluid input and output 116, and a piston shaft 117 joined on the outside to a finger 118 which cooperates with the wedge 112.

In the drawing a blank tap is shown at 57 and a tap threaded by machine R is shown at 57'.

The hydraulic lines connected to the various cylinders 24, 73, 74, 64, 48, 5, 10, 67, and 114 are connected to a supply unit which can work both automatically and manually by means of push button, the mechanical and electrical devices needed to drive the pump being of conventional construction.

The described transport operation functions generally as follows:

Inside the vertical guide 53 there are several chasers 54 all loaded with blank taps 57 which have been placed in these chasers 54 as shown in FIG. 7. It is assumed that as shown in FIG. 1 the threaded machine R has threaded a tap 57 in a previous operation and is retaining it with the jaws 106 of the chuck 104 of the head 95. If the transport operation is effected for the first time the transport device would serve to deliver a blank tap 57 to the machine by means of movement which will be explained below.

In FIG. 1 the assembly is in a position wherein the collet 91 is lined with a tap 57 which in this case is the lowest tap in a row in the magazine chaser 54.

Figure 9:
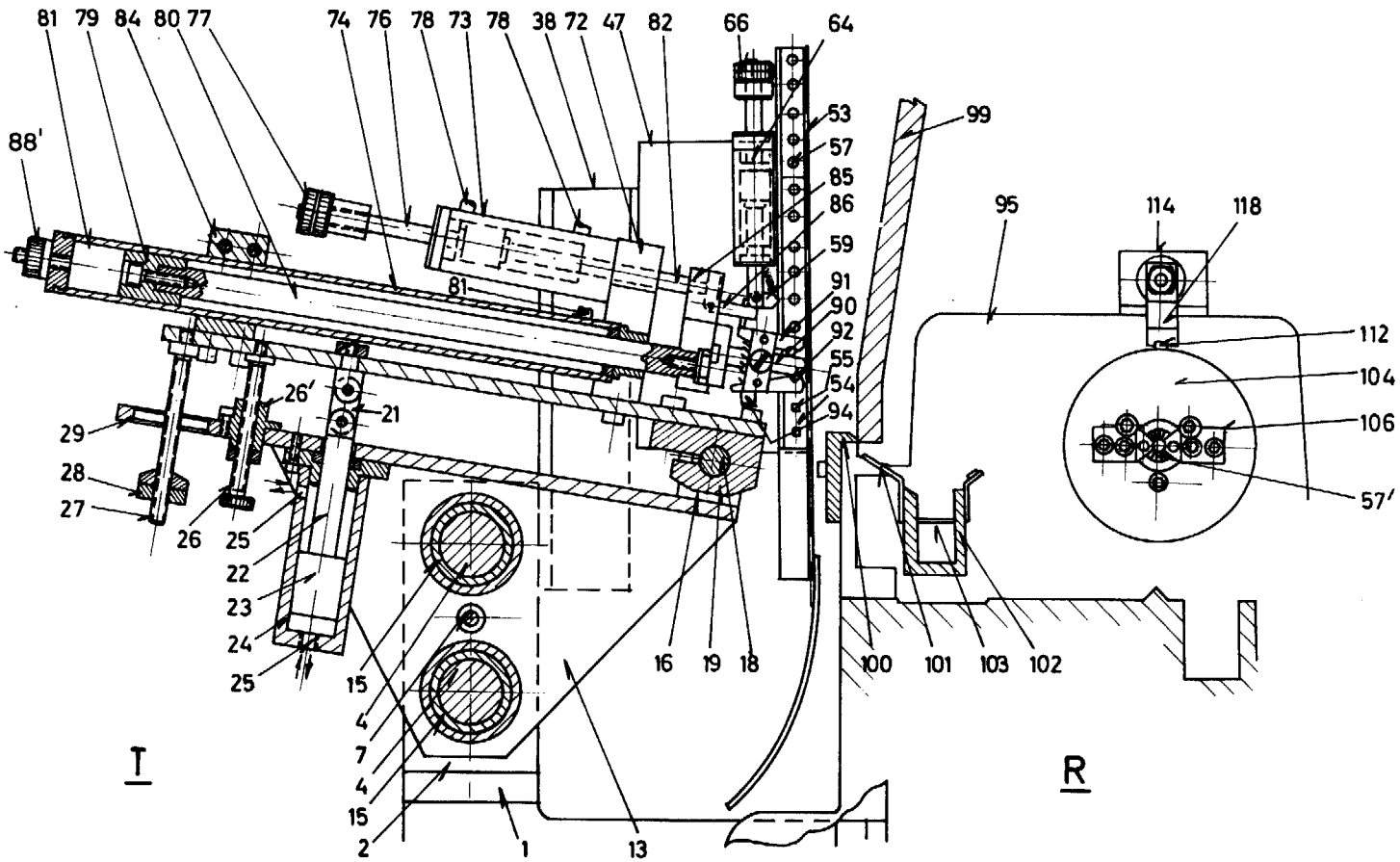
FIGS. 9–12 are views similar to FIG. 1 indicating the apparatus according to this invention in successive operating positions.

First phase: Liquid is injected into the rear of the cylinder 73 so as to advance the piston 74. The small-diameter 83 of its shaft first moves the lever 86 so as to open the collet 91 by means of the screw 87. The larger-diameter portion 82 then pushes body 85 from the position indicated in FIG. 1 to that shown in FIG. 9 wherein the collet 91 has grasped a tap 57 which was aligned with it. Once the cylinder 73 has completed this operation fluid is pumped into its front portion so that the piston 75 retracts and fluid is simultaneously injected into cylinders 67 and 5, the first of which when its ejector 71 advances, releases tap 57 from the chaser 51 in the hole 55, while the latter, via the displacement of shaft 7 in the direction of the dotted-line arrow of FIG. 2, moves the entire collet assembly carrying the tap 57 at a right angle to the plane of the view and toward the observer in FIG. 9 and lines it up with the space between the free and separate points 96 and 97 (FIG. 14) of the thread-cutting machine.

Figure 10:
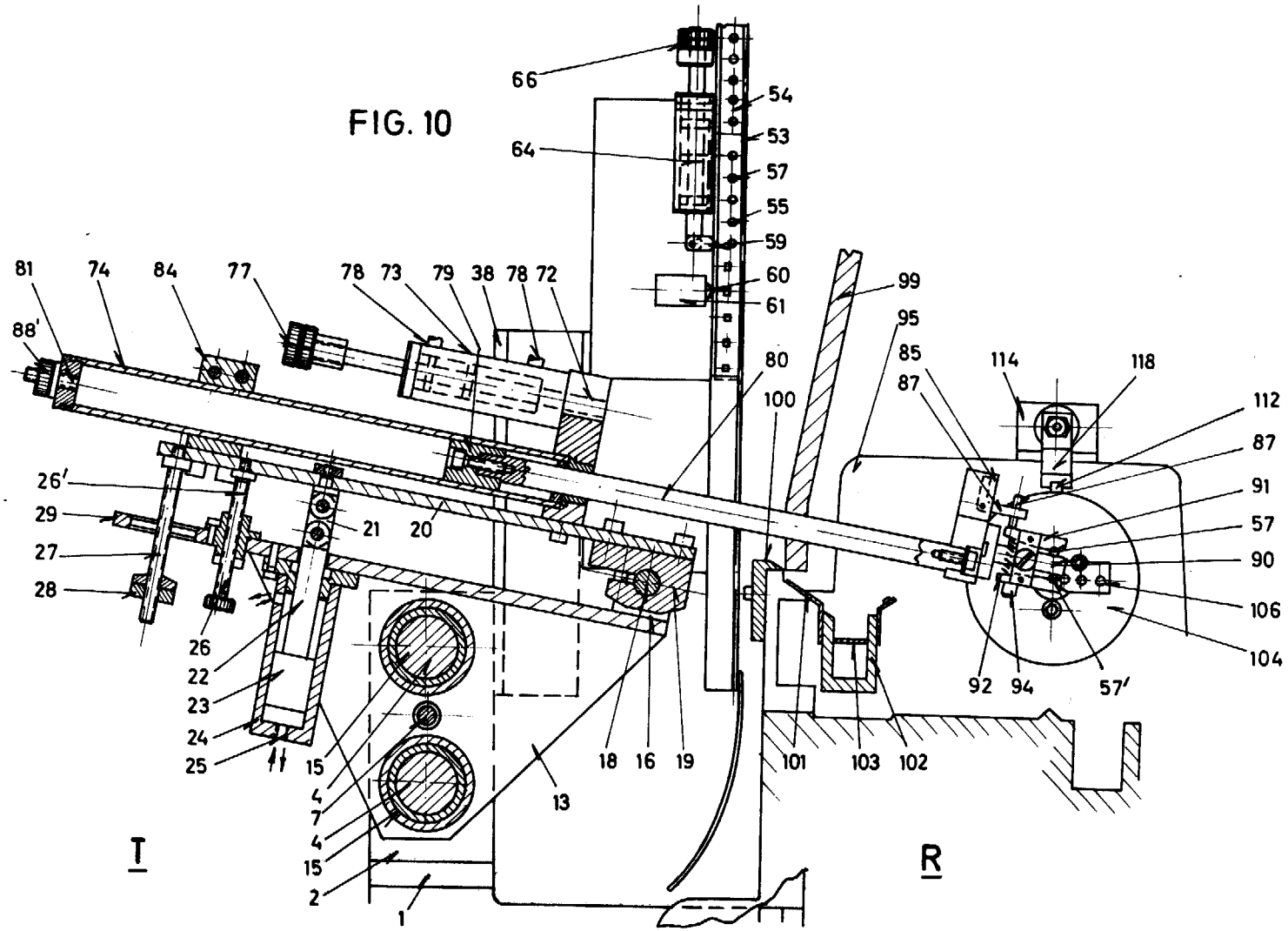

Second phase: The pressurization of cylinder 67 is reversed to retract it and the cylinder 5 remains in the same position while fluid is injected into the upper part of cylinder 48 so that by means of its shaft 50 it raises the entire guide group 53 with the plate 47 to clear the path for the collet device 90 - 92 and for the body 85, and when the rear of the cylinder 74 is then pressurized moves from the position of FIG. 9 to that of FIG. 10 wherein the lower collet 92 which has moved into section R and which opens on contact with the threaded tap 57' retained by jaws 106 holds this tap while the upper collet 91 continues to hold the blank tap 57. In this position the center point 96 is aligned with the axis of the cylinder 74.

Third phase; The vertical guide assembly 53 remains stationary as in the second phase since the cylinder 48 is still not pressurized. On the contrary fluid is injected into the rear of cylinder 114 so that its shaft advances to push wedge 112 (FIG. 14) via the block 118 so as to act on the beveled flats 111 of the levers 108 joined to the jaws 106 and thereby separate the jaws and release the threaded tap 57' which will not fall because it is held by the collet 92. Immediately before this instance, the mobile point 97 of the machine R is retracted in the usual manner once the grind wheel 98 has ended its operation.

Figure 11:
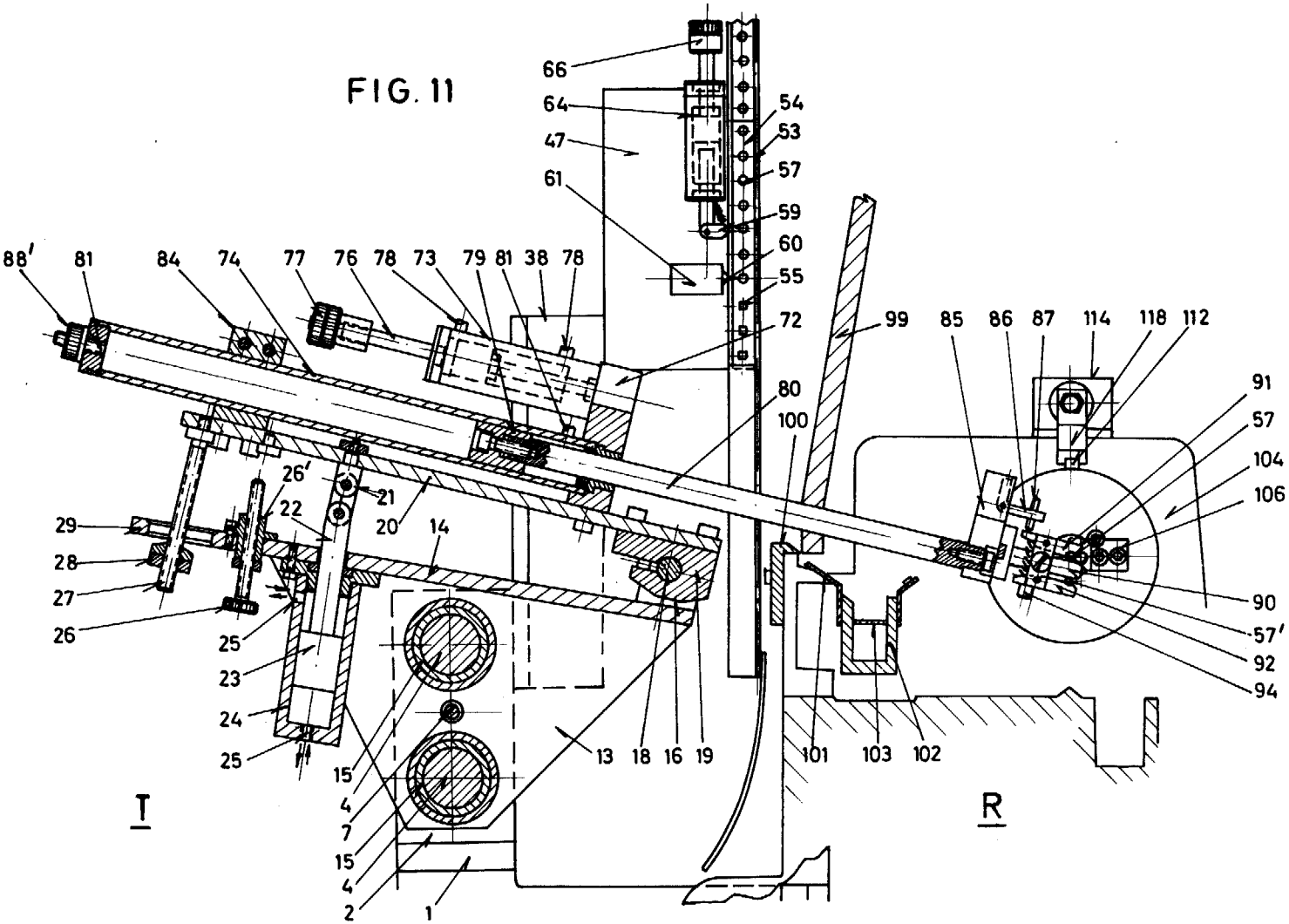

Fourth phase: The jaws 106 remain open and in this position fluid is injected behind the piston 9 of cylinder 10 so that the common shaft 7 moves to a limited extent in the direction indicated by the dotted-line arrow in FIG. 2 so that the collet assembly releases the threaded tap 57' from its jaws 106. Liquid is then injected behind the piston 23 of cylinder 24 so that it acts via the shaft 22 and the compensating articulation 21 to tip the platform 20 about the shaft 18. Such movement is imparted to all of the parts mounted on the platform 20. The collet assembly passes from the position of FIG. 10 to that of FIG. 11 wherein the upper collet is lowered and has lined up its blank tap 57 with the mouth 107 defined by the jaws 106, whereas the lower collet 92 holds the threaded tap 57'. At this time fluid is injected into the cylinder 10 to retract it and cause the entire collet assembly to move toward the jaws 106, that is away from the observer in the plane of the drawing of FIG. 11, and since the blank tap 57 to be threaded is aligned with the mouth of the jaws, when point 97 is advanced into the normal operation position of machine R it fits that tap into the chuck 104 and the jaws automatically close as fluid is fed to retract the cylinder 114 which pulls wedge 112 back to cause the levers 108 and the corresponding jaws 106 to move together under the force of spring 110 and hold the tap 57 by its peg 56. With this tap 57 held between points 96 and 97, it is possible for the grinding wheel 98 to act on it in normal manner.

Figure 12:
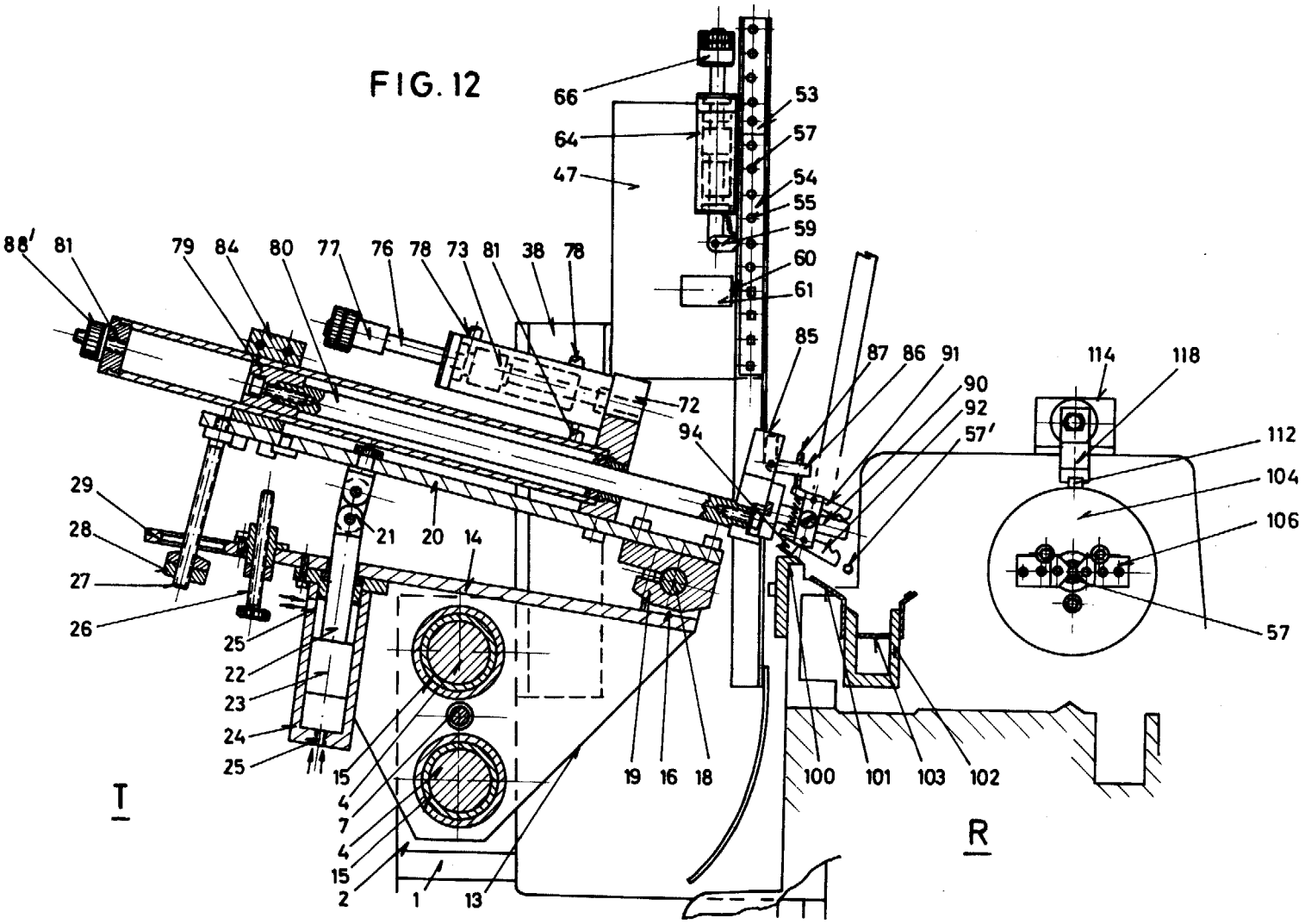

Fifth phase: Fluid is injected into the cylinder 74 to retract it so that the collet assembly moves backwardly and the collet 91 simply pulls free of the tap 57 secured in the chuck 104 as described above, whereas the lower collet 92 carries back the threaded tap 57' until the stop 94 of the collet 92 strikes the stop 100 to open the collet 92 and drop the threaded tap 57' onto the conveyor 103 which carries it to a collector. Thus the machine passes from the position of FIG. 11 to the position of FIG. 12.

Sixth phase: (Return to starting position). When the collet 92 passes over the ridge 100 it closes again. The body 85 comes to rest against the body 72. Fluid is injected into the cylinder 5 to retract it and move the collet assembly in a direction opposite to that indicated by the dotted-line arrow of FIG. 2. Liquid is fed to the cylinders 48, 64, and 24 to extend them, cylinder 48 causing the entire guide group to drop to the initial work position and cylinder 64 by means of pawl 59 and retainer 60 indexes the chaser assembly through a distance equal to the spacing between adjacent slots 58 (FIG. 7) to line up a new blank tap 57 with the upper collet 91 so that operation as described above can take place. Fluid is injected into the cylinder 24 to retract it and make the upper assembly of the device move back into its original inclined position, that is with the collet 91 lined up with the tap 57. In this manner the machine has passed from the position of FIG. 12 to that of FIG. 1 and the device has finished a complete operating cycle.

Knobs 77, 66 and 88' allow the travels of the pistons of the respective cylinders 73, 64 and 74 to be adjusted. Knob 8 serves for varying the displacement in pistons 5 and 9 according to the size of the blank taps to be threaded. The screw 52 adjusts the vertical movement of the entire guide assembly 53. Screws 26 and 27 adjust the platform 20 and all of the elements mounted on it with respect to their inclination to the horizontal. Knob 42 serves to change the horizontal position of the guide assembly 53.

The described transport device is joined to the machine by means of a hinge 34 - 36 (FIGS. 4 and 5), which permits mounting of the support plate 31 to the front of the machine to which it is attached with the help of screws 32. When the device is not needed that is when the thread-cutting machine is to be operated in a normal non-automatic manner, the screws 32 are loosened and the entire assembly T is swung down in a direction toward the observer by pivoting on the shaft 35. This frees machine R for standard operation.

The materials, forms and dimensions of the elements which form part of the described tap transport device are independent of the object of the invention along with the particular characteristics of the injector equipment for the various hydraulic elements, the number of loader chasers, the regulating and adjusting means for operating the different devices which make up the above-mentioned devices and other secondary details which do not affect the essential characteristics of this invention.

The object of the present Patent of invention is claimed as follows:

1. In combination with a thread-cutting machine having a chuck adapted to hold a workpiece to be threaded and to rotate same about a threading axis, a tap transport device comprising:
   - a support frame adjacent said machine;
   - a carrier displaceable on said frame in a first direction transverse to said axis;
   - a workpiece feed gripper and a workpiece removal gripper mounted on said carrier;
   - means on said support frame and spaced in said first direction from said axis for holding a plurality of unthreaded workpieces and feeding same to said workpiece feed gripper;
   - means connected to said workpiece feed gripper for opening and closing same and thereby grasping and releasing a workpiece;
   - means connected to said workpiece removal gripper for opening and closing same and thereby grasping and releasing a workpiece;
   - means for displacing said carrier in a second direction transverse to said axis and to said first direction between a feed position with said feed gripper aligned in said first direction with said axis and a removal position with said removal gripper aligned in said first direction with said axis;
   - means for displacing said carrier in said first direction between an outer end position with said grippers aligned in said second direction with said means for holding and an inner end position with said grippers aligned in said second direction with said axis, whereby when in said inner end position displacement of said carrier into said feed position aligns a workpiece in said feed gripper with said axis and displacement of said carrier into said removal position aligns a workpiece in said removal gripper with said axis; and
   - means for displacing said carrier in a third direction generally parallel to said axis.

2. The device defined in claim 1 wherein each of said means for displacing includes a respective fluid-operated cylinder.

3. The device defined in claim 1 wherein said carrier is pivotal on said housing about a pivot axis substantially parallel to said threading axis, said means for displacing said carrier in said second direction being effective to pivot said carrier about said pivot axis.

4. The device defined in claim 1 wherein said means for holding said plurality of unthreaded workpieces includes a magazine on said support frame adapted to hold said plurality and means for advancing said unthreaded workpieces of said plurality one-by-one past a loading location.

5. The device defined in claim 4 wherein said feed gripper is aligned in said first direction with said loading location in one of said positions of said carrier.

6. The device defined in claim 5 wherein said one position is said removal position.

7. The device defined in claim 1 wherein said means connected to said grippers each include a spring biasing the respective gripper into a closed position.

8. The device defined in claim 1 wherein each of said grippers includes a holding element movable pincher-fashion toward and away from said carrier.

9. The device defined in claim 1 wherein said first direction is generally horizontal, said axis being generally horizontal, said second direction being generally vertical.

10. The device defined in claim 1, further comprising means for displacing said means for holding in a fourth direction transverse to said first direction from a position alignable in said first direction between said feed gripper and said axis to a position clear of the path traveled by said feed gripper in said first direction on displacement of said carrier between said end positions.

11. The device defined in claim 1 wherein said means for opening said removal gripper includes mechanism engageable with said removal gripper on displacement of said carrier from said inner position into said outer position.

12. The device defined in claim 11 wherein said mechanism is only engageable with said removal gripper in said feed position of said carrier.

13. The device defined in claim 11, further comprising means underneath said carrier for receiving a workpiece dropped from said removal gripper on opening thereof.

14. The device defined in claim 1, further comprising control means connected to all of said means for sequentially:

closing said feed gripper on an unthreaded workpiece in said means for holding;

displacing said carrier into said removal and inner end positions and closing removal gripper on a threaded workpiece in said chuck;

displacing said carrier from said removal to said feed position and thereby positioning the unthreaded workpiece in said chuck; and displacng said carrier into said outer end position.

15. The device defined in claim 1, wherein said machine includes jaws at said chuck, means for opening and closing said jaws to hold a workpiece on said axis, and means adjacent said chuck for threading a workpiece held therein.

* * * * *